United States Patent [19]

Boccia

[11] Patent Number: 4,879,851

[45] Date of Patent: Nov. 14, 1989

[54] HOLLOW KICK MOLDING

[76] Inventor: Joseph Boccia, 131 Searingtown Rd., Albertson, N.Y. 11507

[21] Appl. No.: 157,219

[22] Filed: Feb. 18, 1988

[51] Int. Cl.[4] ..... E02D 19/00

[52] U.S. Cl. ..... 52/169.5; 52/169.14

[58] Field of Search ..... 52/169.5, 169.14

[56] References Cited

U.S. PATENT DOCUMENTS

| | | | |
|---|---|---|---|
| 3,283,460 | 11/1966 | Patrick | 52/169.5 |
| 3,304,672 | 2/1967 | Bakke | 52/169.5 |
| 3,571,994 | 3/1971 | Brown | 52/775 |
| 3,846,948 | 11/1974 | Dallen | 52/396 |
| 4,075,800 | 2/1978 | Molick | 52/169.5 |
| 4,245,443 | 1/1981 | Beechen | 52/169.5 |
| 4,265,064 | 5/1981 | Parezo | 52/169.5 |
| 4,660,333 | 4/1987 | Romer | 52/169.5 |

FOREIGN PATENT DOCUMENTS

| | | | |
|---|---|---|---|
| 1115536 | 11/1982 | Canada | 52/169.5 |

*Primary Examiner*—Henry E. Raduazo
*Attorney, Agent, or Firm*—Bauer & Schaffer

[57] ABSTRACT

A kick-molding and drainage system for below grade "floating" platform structures wherein a trench is dug in the ground between vertically extending walls and a concrete floating floor spaced therefrom to form a seepage channel. A plastic or rubber molding strip having a flat vertically disposed body provided with a straight lower edge and a shaped crown along its upper edge. The crown has a flat lower wall and a roof. The rear face of the body is provided with a plurality of vertical ribs that extend outwardly. When installed, the kick-molding is located in the trench so that the flat lower wall of the crown abuts the floor slab, the roof of the crown hides the gravel channel and encloses the same from sight while at the same time, the ribs keep the molding spaced from the wall, thus permitting condensation to seep into the trench by way of the channel and allowing the trench to aerate.

7 Claims, 1 Drawing Sheet

Fig. 1
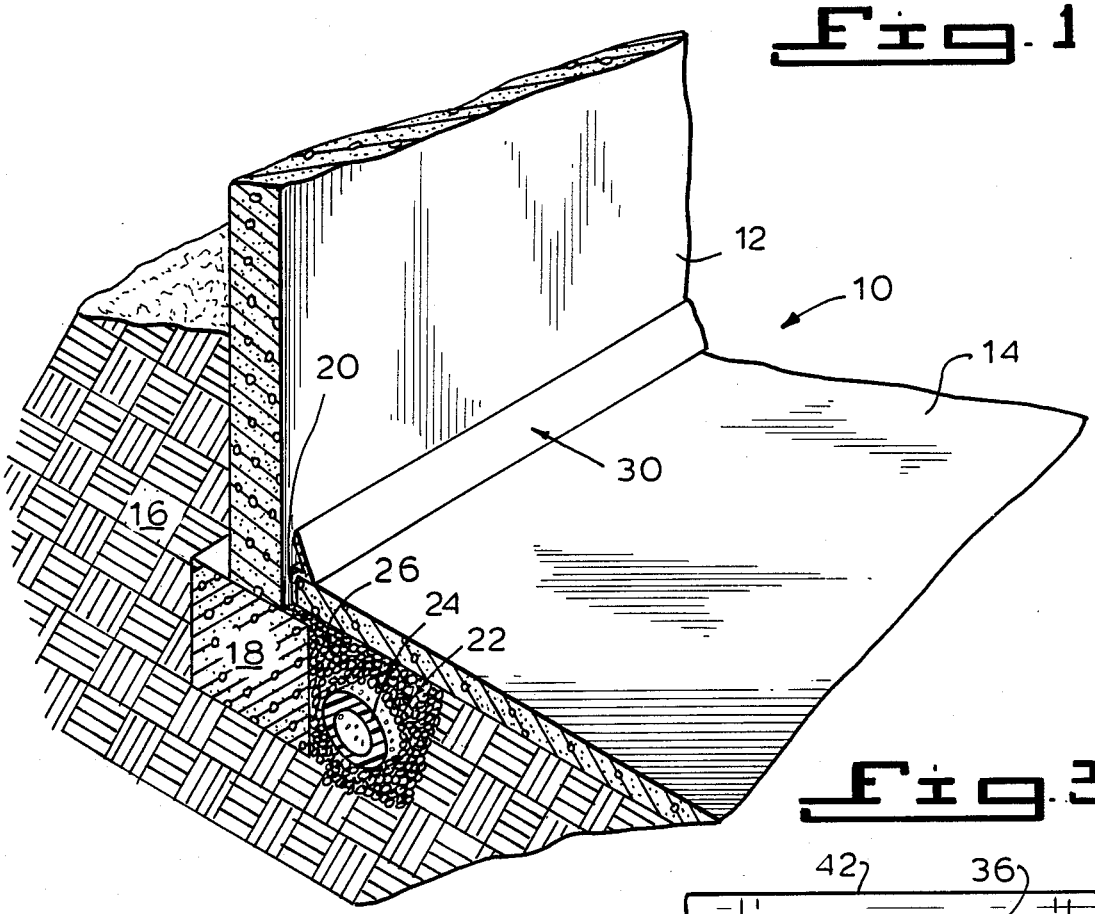
Fig. 3
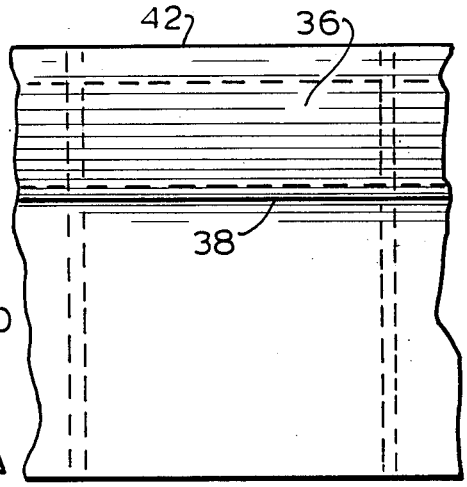
Fig. 2
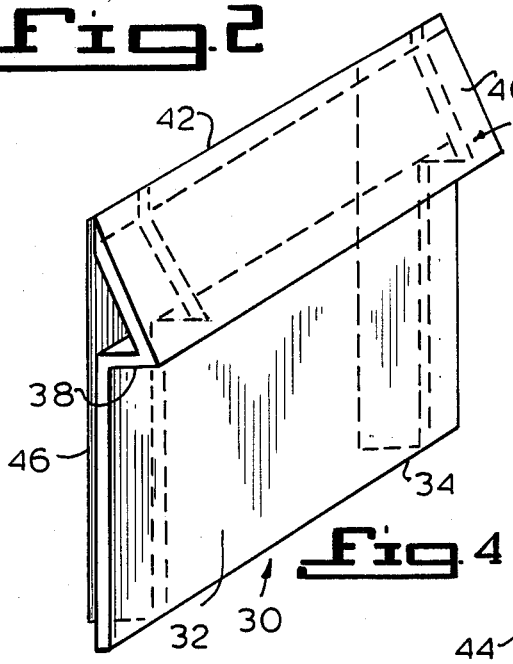
Fig. 4
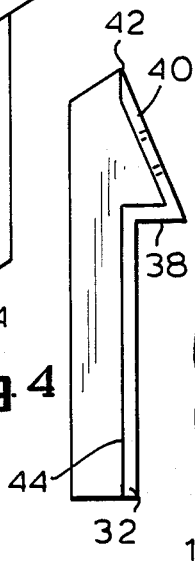
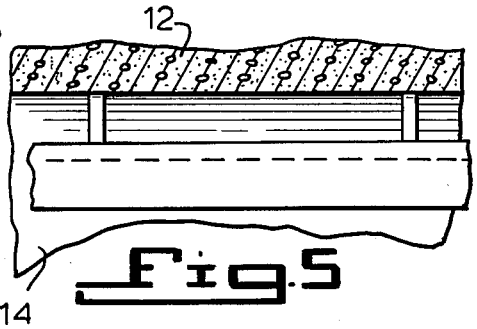
Fig. 5

HOLLOW KICK MOLDING

BACKGROUND OF THE INVENTION

This invention relates to a kick-molding and a drainage system employing the same. More particularly, the invention relates to a kick-molding and a drainage system for below grade "floating" platform structures.

A wide variety of drainage systems are known which are useful in waterproofing building structures. For example, Molick, U.S. Pat. No. 4,075,800 discloses a foundation aqueduct and expansion joint in which a U-shaped, trough-like duct is positioned on the inner face of a building foundation, between the concrete flooring and the foundation of the basement of the building structure and which drains into conventional drainage tiles located underneath the flooring. In another embodiment, the U-shaped, trough-like duct is secured on top of the concrete flooring against the inner face of the foundation wall and is drained directly into a sump or drainage conduit for the basement floor and interior wall paneling can extend into the open top of the duct. In still another embodiment, the existing basement flooring can be routed adjacent the foundation wall forming a channel to receive the trough-like duct. In installations where the duct is positioned between the basement flooring and the foundation wall, the duct acts as an expansion joint. In installations where the duct is exposed at the level of the basement floor, perforated, inverted, re-shaped covers can be snapped into the open top of the duct to prevent entry of solid objects. The ducts are preferably formed of extruded plastic, although they may be made of metal.

In Beecham U.S. Pat. No. 4,245,443, there is disclosed an arrangement for preventing seepage through a wall from running onto a poured concrete floor of a basement or the like, which comprises a vertical channel member positioned between the wall and the floor and having flat surfaces spaced from the wall, and a water impermeable facing strip abutting the flat surfaces. A horizontal channel member having spaced flat surfaces abuts a footing which supports the walls, and alternate spaced flat surfaces spaced from the footing with the concrete floor being poured directly on the horizontal channel member.

In Golden, U.S. Pat. No. 4,411,112, there is disclosed a resilient strip for self-sealing, self-stabilizing installation in a floor expansion void located in the walls of a room and the edge of the floor. The main body of the resilient strip is generally triangular in cross-section with a recessed base adapted to engage the wall side of the expansion void and a truncated apex adapted to seal against the floor side of the expansion void adjacent its work edge, thereby placing the upper and lower sides of the strip in compression transversely thereof. The upper edge of the strip preferably includes an integral baseboard flange tapering to a thin wall-hugging edge. The strip requires fasteners or adhesives for installation.

In DiCello, U.S. Pat. No. 4,538,386, there is disclosed a drainage system for draining water away from a building having a horizontal base and walls extending vertically from the base. The system includes first drain means located in a first trough provided in the ground beneath the base inside the perimeter thereof. The first trench extends around the perimeter of the base and inside of the vertically extending walls. Second drain means is located in a second trench provided in the ground adjacent the ground surface and adjacent the perimeter of the horizontal base, the second trench extending around the perimeter of the horizontal base and outside the vertically extending walls. Gravel filling is provided in the first and second trenches and cover at least partially, the first and second drain tiles.

While the above described structures are useful for their stated purposes, they are in some respects, complicated structures which still do not solve satisfactorily the extent needed in the permeation of water at the cove areas, that is the areas where the concrete floor slab abuts the concrete foundation walls, due to saturated ground and high water tables by removing the water before its appearance above the floor.

Moreover, in most instances, they still involve the use of an open gravel channel at the cove for the purposes of allowing air and water to enter the system and facilitate accumulation of water. Still further, the described structures still require a two step procedure for creation of the channels and and do not remedy its unaesthetic appearance; or in cases where there are relatively complex structures. There exists, therefore, the need for a drainage system for draining water away from the interior of a building structure located on the ground and a molding for use therewith which is capable of ventilation, capable of permitting water to pass behind it to the drainage system, capable of accumulating water between the vertical section thereof and the walls of the building structure and which has an aesthetic appearance while at the same time, eliminating the need for a gravel channel at the cove area and also which permits a one-step application for concrete installation in that it can be used as well as the form, being placed in situ on paving the concrete floor. The present invention fulfills such a need.

The foregoing objects and advantages, together with other objects and advantages, are set forth in the following disclosure.

SUMMARY OF THE INVENTION

In accordance with the invention, there is provided a drainage system for draining water away from the interior of a building located on the ground and having a surface above which a portion of the building extends. The building has a horizontal disposed base lying adjacent the ground, walls extending vertically from the base and a horizontally disposed floor and located inside the walls. The perimeter of the floor extends around the walls and is spaced therefrom along its peripheral edge. The system comprises drain means disposed in a trench in the ground located adjacent the base and extending around the perimeter thereof inside the wall and beneath the floor, and a molding comprising an elongated strip having a vertically disposed body located in the space formed along the peripheral edge of the floor and around the perimeter of the walls and which molding extends downwardly into the trench.

In accordance with the present invention, there is also provided a kick-molding comprising an elongated strip having a flat vertically extending body provided with a straight lower edge, a shaped crown along its upper edge, and a plurality of vertically disposed ribs located on the rear face thereof, the molding being adapted to be inserted into the space formed along the peripheral edge of the floor and the walls of the building.

Full details of the present invention are set forth in the following description and are illustrated in the accompanying drawings.

DESCRIPTION OF THE DRAWINGS

IN THE DRAWINGS:

FIG. 1 is a perspective partial vertical sectional view of a portion of a building having a below ground foundation wall with the drainage system of the present invention applied thereto and showing the kick-molding in place in the space formed between the peripheral edge of the floor and walls of the building;

FIG. 2 is a view in elevation and perspective of the kick-molding of the present invention showing in a broken line, a number of the vertical disposed ribs located on the rear face of the body thereof;

FIG. 3 is a front view of the kick-molding shown in FIG. 2;

FIG. 4 is an end view in elevation of the kick-molding illustrated in FIG. 2; and FIG. 5 is a partial plan view of the kick-molding illustrated in FIGS. 2 and 3 showing two of the vertically disposed ribs in broken lines.

DESCRIPTION OF THE PREFERRED EMBODIMENTS

Referring now more particularly to FIG. 1, the illustrated drainage system of this invention is applied in the basement of a building, generally depicted by the numeral 10. The basement 10 comprises a room bordered by a plurality of walls 12 (only one shown) having a floor 14 lying directly on the building base, for example the ground 16. The walls 12 rest on a concrete footing 18 and extend vertically being separated by a space 20 from the perimeter of the floor 14, thereby allowing the floor 14 to "float" with the movement of the ground. A trench 22 is dug in the ground 16, about the periphery of a room 10. The trench 22 may vary in size and depth, but is generally about 18 inches wide and sufficiently deep to accommodate disposition therein of a perforated pipe 24, which is provided with a discharge outlet (not shown) leading to a sewer, cesspool or other drain and which is buried in a porous stone and gravel aggregate 26 disposed in the trench 22.

In order to prevent excess water from creating hydraulic pressure beneath the floor 14, the space 20 between the floor 14 and wall 12 is left sufficiently wide to allow water and condensation to freely pass into the drainage trench 22 thereby forming a channel. Generally, the space 20 which is preferably filled with gravel, is about one to two inches wide and must remain open to permit evaporation of moisture and aeration of the basement 10, and also to permit condensation on the walls of the building structure to enter into the trench 22. Having an open space 20 or gravel channel exhibits many disadvantages. Not only does it have an unaesthetic appearance, presenting an unsightly opening between floor 14 and wall 12 to a householder, but it also presents an opening into which valuable articles may fall, as well, and prevents complete finishing of the floor with carpeting, woodwork or the like.

The use of ordinary molding strips of wood or plastic, in conventional form, or even in curved cove shape, to cover the opening is not in itself satisfactory since conventional molding or coving does not allow for water passage, weeping, or condensation and itself becomes unsightly after a time due to its eventual separation from the wall and floor as a result of the floating floor. To ovecome the problem inherent in the prior art, a kick-molding 30 having a construction in accordance with the detailed description set forth hereinbelow, is disposed in the cove area to hide the space 20 while still permitting the space to perform its required function of allowing passage of water and condensation.

The particular structure of the kick-molding 30, provided by this invention, is more precisely seen in FIG. 2 and comprises an elongated strip, preferably of plastic or the like forming a flat vertically disposed body 32 provided with a straight bottom edge 34 and a shaped crown 36 along its upper edge. The shaped crown 36 is provided with a flat horizontal lower wall 38 extending forwardly of the body 32 and a rearwardly slanting roof 40, terminating in a straight edge 42 aligned in the plane of the rear face 44 of the body 32. A plurality of vertical ribs 46 are spaced uniformly along the rear face 44 of body 32 and extend from about ½ inch to ¾ of an inch beyond the rear face of the strip, although this distance may vary depending upon particular needs.

Referring once again to FIG. 1, the body wall 32 of the kick-molding 30 of the is located in the space 20 so that the bottom edge 38 of the crown abuts the surface of the floor 14. The ribs 46 maintain the kick-molding 30 betwen the wall 12 and floor 14 and the body wall spatially fixed from the wall 12 along its entire length. Condensation is thus permitted to seep into the trench 22 by passing between the wall and the edge 42. The same spacing between the edge 42 and the wall 12 also permits the trench i.e space 20 to be properly aerated. The crown 36 provides an aesthetically appealing closure for the space 20 effecting sealing the floor 14 along its periphery and restricting and opening into the space 20 from above the floor.

The hollow kick-molding 30 of this invention, is preferably made of plastic, rubber on rubber-like material, although it may be made of metal and can be conveniently sized to particular need. Generally the bottom edge 34 of body 32 sits about two and three quarter inches below the surface of the floor 14 and one and one half inches away from the wall, allowing only a one half inch void behind it. Thus the trench 22 is capable of ventilation, and water is permitted to pass behind the kick-molding while, at the same time, the unsightly appearance of the gravel in the channel space is eliminated. The kick-molding 30 is further capable of conjoint movement with the floor 14, should the floor heave or float, and dislocation of the molding from its wedged position between wall and floor is prevented. The molding, thus, does not bulge or flex, nor does it separate from wall or floor.

The kick-molding of the present invention is preferably installed in a single step, being easily used as the pouring form for the construction of the floor. That is the molding 30 is placed in situ on the ground base, at the foot of the wall 10, before the concrete of the floor 14 is poured and remains in place after the floor hardens. Thus, both the installation of the floor and molding are made easier and swifter. It may also be used as a replacement for existing installation since the molding may be easily sized and shaped and inserted within a pre-existing space between the floor and the wall. Still further, the hollow kick-molding of the present invention, being made preferably of plastic or rubber or the like, does not rot in use in contrast to wood or linoleum moldings which would also completely close the opening to the gravel channel. Numerous other advantages of the hollow kick-molding are the drainage system of the present invention will be readily apparent to those skilled in the art.

It is to be understood that numerous variations of the described preferred embodiments of this invention may be made without departing from the spirit of the invention and this invention is not to be limited to the described embodiments except as defined in the appended claims.

What is claim is:

1. A drainage system for draining water away from the interior of a building located on the ground having a surface above which a portion of the building extends, said building having a horizontally disposed base lying adjacent the ground, walls extending vertically from said base and a horizontally disposed floor located inside said walls spaced from said walls and defining therewith a continuous space for the passage of moisture therebetween, the drainage system comprising drain means deposed in a trench in the ground adjacent said base and extending around the perimeter of said floor inside said walls and beneath said space between floor and said walls, a molding comprising an elongated strip having a flat vertically disposed body provided with a straight lower edge and a shaped crown, said crown including a flat lower wall and an enclosed roof having straight upper edge, said molding having its vertically disposed body extending downwardly through said space between the wall and said floor in abuttment with the peripheral edge of said floor so that the lower wall of the crown rests on said floor and the upper edge of the enclosed roof extends toward said wall hiding said space.

2. A drainage system according to claim 1, wherein the molding is made of plastic.

3. A drainage system according to claim 1, wherein the molding is made of rubber.

4. A drainage system according to claim 1, wherein the molding includes a plurality of vertically disposed ribs located on the rear face of the body thereof to maintain said molding in a spaced relationship with regard to the walls and permit the trench to aerate and condensation to seep into said trench.

5. A kick-molding for drainage of water and condensation between the floor and walls of below ground building structures, said molding being inserted into the space formed along the peripheral edge of the floor and the wall of the building structure and comprising an elongated integrally formed strip having a flat vertically disposed body provided with a straight lower edge, a shaped crown along its upper edge including a flat lower wall and a roof, and a rear face having a plurality of vertically disposed ribs located thereon, said kick-molding being disposed when inserted in said space with the vertical body thereof extending downwardly into abuttment with the peripheral edge of said floor and the ribs in abutment with the wall of the building structure to provide vertical drainage passages between the wall and the floor and said crown of said kick molding abutting the upper surface of said floor to hide said space between the wall and the floor.

6. A kick-molding according to claim 9, which is plastic.

7. A kick-molding according to claim 9, wherein is rubber.

* * * * *

UNITED STATES PATENT AND TRADEMARK OFFICE

CERTIFICATE OF CORRECTION

PATENT NO. : 4,879,851

DATED : November 14, 1989

INVENTOR(S) : Joseph Boccia

It is certified that error appears in the above-identified patent and that said Letters Patent is hereby corrected as shown below:

column 5, line 19 "deposed" should be --disposed-- column 6, line 29 "claim 9, whick" should be --claim 5, whick-- column 6, line 31, "claim 9, wherein" should be --claim 5, which--

Signed and Sealed this

Sixth Day of November, 1990

*Attest:*

*Attesting Officer*

HARRY F. MANBECK, JR.

*Commissioner of Patents and Trademarks*